US005662064A

United States Patent [19]

György

[11] Patent Number: 5,662,064

[45] **Date of Patent: *Sep. 2, 1997**

[54] HIGH ACOUSTIC OUTPUT HORN

[76] Inventor: Laszlo György, Széchenyi u. 19, H-2013 Pomáz, Hungary

[ * ] Notice: The term of this patent shall not extend beyond the expiration date of Pat. No. 5,460,116.

[21] Appl. No.: 408,902

[22] Filed: Mar. 22, 1995

Related U.S. Application Data

[63] Continuation-in-part of Ser. No. 232,187, filed as PCT/HU92/00043, Oct. 30, 1992, published as WO93/09530, May 13, 1993, Pat. No. 5,460,116.

[30] Foreign Application Priority Data

Oct. 30, 1991 [HU] Hungary ..... 3409/91

[51] Int. Cl.[6] ..... G10K 9/04

[52] U.S. Cl. ..... 116/142 FP; 116/142 R

[58] Field of Search ..... 116/137 R, 142 R, 116/142 FP, 142 FV, 138, 59

[56] References Cited

U.S. PATENT DOCUMENTS

| | | | |
|---|---|---|---|
| 870,074 | 11/1907 | Astrom . | |
| 1,655,675 | 1/1928 | Cunningham . | |
| 1,679,011 | 7/1928 | Widmyer . | |
| 2,370,939 | 3/1945 | Cooney | 116/142 FP |
| 2,918,895 | 12/1959 | Buel . | |
| 3,000,344 | 9/1961 | Ferrell | 116/142 FP |
| 3,429,294 | 2/1969 | Holm | 116/142 R |
| 3,785,335 | 1/1974 | Wagner | 116/142 R |
| 4,970,983 | 11/1990 | LeBlanc . | |
| 5,460,116 | 10/1995 | György | 116/142 FP |

FOREIGN PATENT DOCUMENTS

| | | | |
|---|---|---|---|
| 8701850 | 3/1987 | WIPO | 116/137 R |
| 93 09530 | 5/1993 | WIPO . | |

*Primary Examiner*—William A. Cuchlinski, Jr.
*Assistant Examiner*—Willie Morris Worth
*Attorney, Agent, or Firm*—Herbert Dubno

[57] ABSTRACT

A high output horn for sports' fans can have a pair of plastic tubes spanned at one end by a membrane with a setback of the outer tube from the inner tube of 0.1 to 0.3 mm and a ratio of the inner diameters of the two tubes between 1.1 and 1.7 and a ratio of the outer diameter of the thickness of the membrane spanning the tubes of substantially 1000 to 2000. Air is blown in through a lateral opening in the outer tube and the end opposite the membrane of the air gap between the two tubes is closed.

10 Claims, 2 Drawing Sheets

HIGH ACOUSTIC OUTPUT HORN

CROSS REFERENCE TO RELATED APPLICATIONS

This application is a continuation-in-part of Ser. No. 08/232,187, (now U.S. Pat. No. 5,460,116), filed Apr. 28, 1994, as a national phase application of PCT/HU 92/00043, filed Oct. 30, 1992, and based, in turn, upon Hungarian national application No. 3409/91, filed Oct. 30, 1991.

FIELD OF THE INVENTION

My present invention relates to a high acoustic output horn which can be utilized by a sports' fan or other individual, simply by blowing through a hole of the horn to generate outputs in excess of 100 dB and capable of being used at sporting events to show pleasure or displeasure and at other occasions to generate warning or other sounds.

BACKGROUND OF THE INVENTION

The use of a membrane in conjunction with air under pressure to generate sound is widely known and horns of this type can be used as ship's horns and sirens in factories. They generally are somewhat massive. Hungarian patents 89,973, 95,819, 98,353, 100,289 and 101,300 all disclose horns of this type utilizing prestressed metal sheets as the membranes and having a pair of tubes against which the membrane lies.

In U.S. Pat. No. 4,970,983, a horn is mounted on a pressurized fluid container and has a membrane of stainless steel against which a spring can bear. This membrane is received in a chamber and extends from the end of an inner tube to an outer housing member with a slight incline to the axis.

A signal device using a similar pressure source is found in U.S. Pat. No. 1,679,011 with a planar membrane or diaphragm. Similar structures are found in U.S. Pat. Nos. 870,074 and 2,918,895.

In my earlier application, the membrane, although not a metal membrane, is planar as well.

OBJECTS OF THE INVENTION

It is the principal object of the present invention to develop the principles set forth in my earlier application and provide a horn which can be of comparatively small dimensions and yet can generate high acoustic outputs, usually above 100 dB with a comparatively small amount of pressure, enabling the horn to be utilized by the mouth of the user.

Another object of the invention is to provide a simple, compact horn which can have its output frequency varied in a simple manner and yet can generate large amplitude sound.

It is another object of the invention to provide an inexpensive and easily fabricated horn, readily operated by the mouth of the user and having a surprisingly high output.

SUMMARY OF THE INVENTION

These objects and others which will become more readily apparent hereinafter are attained, in accordance with the invention, in a horn which is of light weight and simple construction comprising an inner sound tube and an outer pressure tube, the latter having a lateral opening into which air is blown by the mouth of the user. At one end, the clearance between the tubes is closed while at the opposite end, the outer tube is set back from the end of the inner tube and the ends of the tube are spanned by a flexible membrane as described in my earlier application, which is included herein in its entirety by reference.

Surprisingly, I have found that with flexible membranes of polyethylene, polypropylene, cellophane, paper or rubber having a thickness V of 0.01 to 2 mm, optimally high outputs can be achieved when the setback has a value in the range between 0.1 and 0.3, the ratio of the diameter $D_2$ of the outer tube to the diameter $D_1$ of the inner tube is between 1.1 and 1.7 and the ratio between the diameter $D_2$ and the thickness V of the membrane is substantially 1000 to 2000. While, at first blush, it would appear that factors like the stirrness of the membrane would be controlling, I have found surprisingly that the critical dimensions given above are significantly more important as long as the membrane is stretched across the tube ends. By contrast with metal diaphragm horns, relatively small pressures of say 10 kPa can be used to generate very high sound amplitudes.

According to a feature of the invention, $\Delta$, the aforementioned setback has a value of about 0.2, $D_2/D_1$ has a value of about 1.3 and $D_2/V$ has a value of about 1400.

The width of the air gap between the tubes is preferably at least 0.2 mm while the diameter of the sound hole can be between 0.2 and 50 mm and preferably is around 10 mm.

The horn of the present invention thus can comprise:

- a sound tube of substantially cylindrical configuration having a sound-generating end and a sound-emitting end;
- a pressure tube coaxially surrounding the sound tube and defining an all-around clearance therewith closed at the sound-generating end of the sound tube and extending to an end of the pressure tube having an axial setback $\Delta$ from the sound-generating end;
- a polyethylene, polypropylene, cellophane, paper or rubber membrane having a thickness V between 0.01 and 2 mm stretched across the sound-generating end of the sound tube and the end of the pressure tube, the sound tube having an internal diameter $D_1$ at the sound-generating end and the pressure tube having an internal diameter $D_2$ at the end thereof;
- a retaining ring fitted over the pressure tube and anchoring the membrane thereto; and
- a horn-blowing hole formed laterally in the pressure tube and opening into the clearance whereby, upon blowing into the hole sound is generated by the membrane and emitted from the sound-emitting end of the sound tube.

$\Delta$ ranging between substantially 0.1 and 0.3, $D_2/D_1$ ranging between substantially 1.1 and 1.7, and $D_2/V$ ranging between substantially 1000 and 2000.

Extension tubes may be mounted at the sound-emitting end of the horn and depending upon the member of such extension tubes, can change the pitch.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
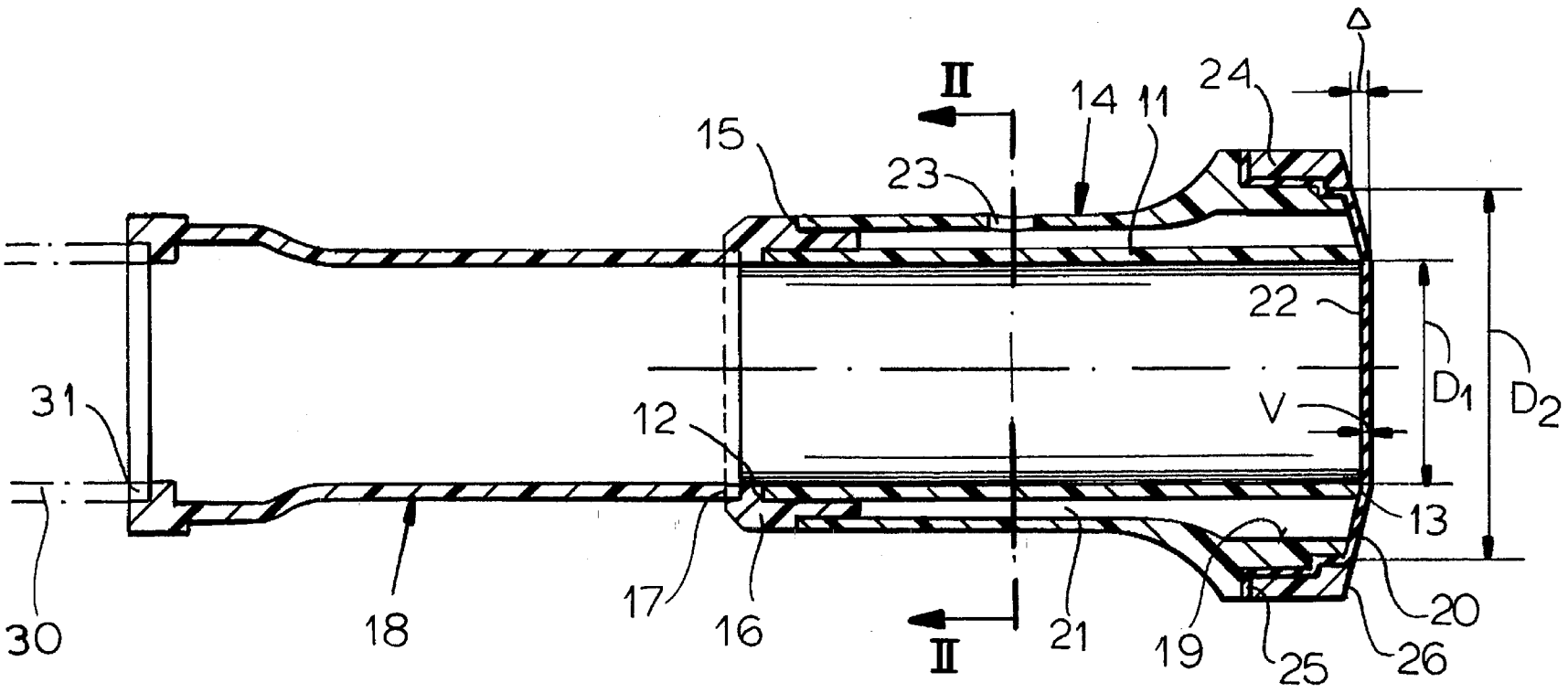
FIG. 1 is a cross sectional view of a horn according to the invention provided with one extension tube and showing the possibility of adding others.
Figure 2:
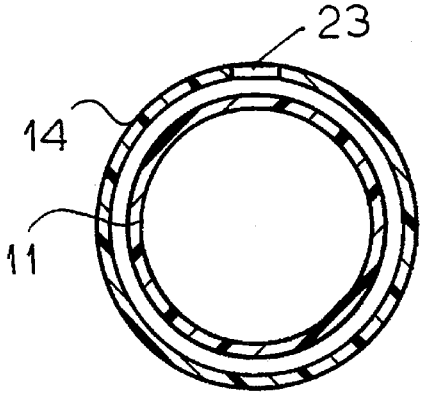
FIG. 2 is a cross sectional view taken along line II—II of FIG. 1.
Figure 3:
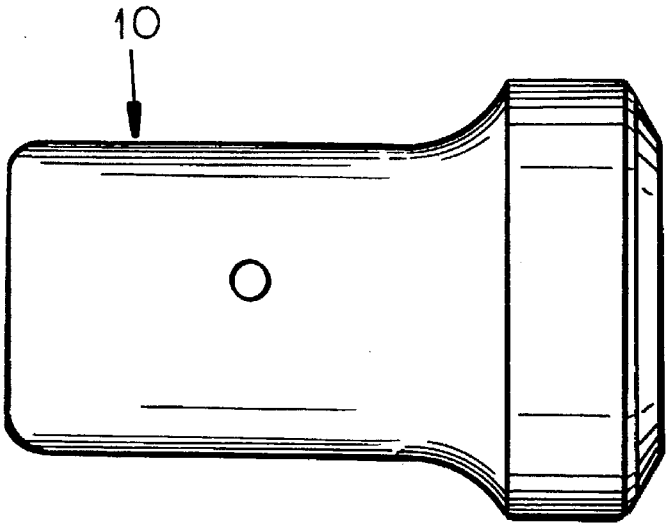
FIG. 3 is an elevational view of the horn of FIG. 1.
Figure 4:
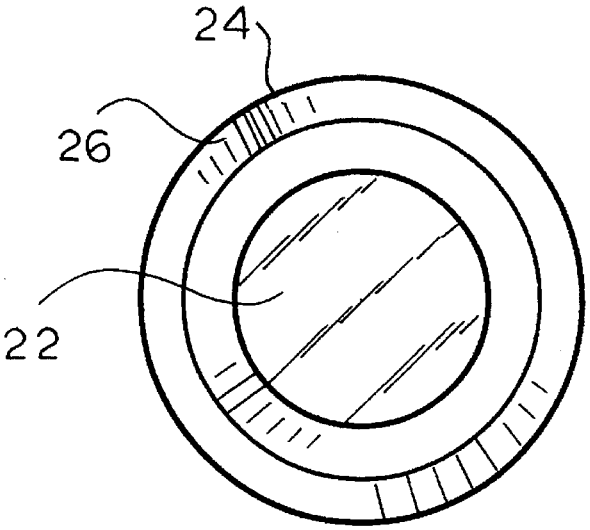
FIG. 4 is an end view of the horn of FIG. 1 showing the membrane stretched across the tubes.

The horn 10 shown in the drawing comprises an inner or sound tube 11 having a sound-emitting end 12 and a sound-generating end 13, coaxially received in a pressure tube 14 which, at its end 15 remote from the sound-generating end, is connected to the sound-emitting end 12 of the second tube 11 by a collar 16. The latter is formed with a recess 17 in which an additional tube 18 can be received but not anchored with sufficient force as to enable the horn to be utilized as a weapon if either the horn or the additional tube 18 is gripped.

At its opposite end, the tube 14 has an enlargement 19 terminating in an end face 20. The tube 14 is separated from the tube 11 by an all-around clearance 21 extending to the end 20 and thus closed in the region of this end by a flexible membrane 22 which is composed of polyethylene, polypropylene, cellophane or rubber and has a thickness V of 0.01 to 2 mm and preferably 0.2 mm.

The tube 14 is also laterally formed with a hole 23 through which air can be blown into the clearance 21. The membrane 22, bridged across the end of the tubes, is anchored by a retaining ring 24 force-fitted into a step 25 formed on the enlargement 19 of the tube 14. The outer surface of the ring 24 is flush with the outer surface of the step 25 and the end face 26 of the ring 24 is slightly beveled.

The end 20 of the pressure tube 14 is set back slightly from the end face 13 by a setback Δ.

the inner diameter of the sound tube 11 is represented at $D_1$ and the inner diameter of the pressure tube at the end face 20 is represented at $D_2$.

Both of the tubes are cylindrical.

The diameter of the sound hole 23 is 0.2 to 50 mm and preferably about 10 mm. The width of the air gap 21 is at least 0.2 mm.

The horn of the invention, when air is blown into the hole 23, generates an output in excess of 100 dB when Δ ranges between substantially 0.1 to 0.3 and is preferably 0.2, when V is such that the ratio $D_2/V$ is between substantially 1000 and 2000 and preferably is about 1400 and when the ratio $D_2/D_1$ is between 1.1 and 1.7 and is preferably about 1.4.

As can be seen from FIG. 1, moreover, an additional extension tube 30, identical to the extension tube 18, may be fitted into a recess 31 in the end of the tube 18 opposite that engaging in the horn. As additional extension tubes are added, the pitch is lowered. All of the tubes can be composed of injection-molded plastic. The extension tubes are arranged to be readily freed from the recesses, should an attempt be made to use the horn as a weapon.

The outer diameter of the horn at the ring 24 may be about 50 mm and at the hole 23 about 35 mm. The inner diameter $D_1$ may be about 25 mm.

The length of the horn may be about 70 mm and the extension tubes may be of similar length.

I claim:

1. A high acoustic output horn comprising:

a sound tube of substantially cylindrical configuration having a sound-generating end and a sound-emitting end;

a pressure tube coaxially surrounding said sound tube and defining an all-around clearance therewith closed at said sound-generating end of said sound tube and extending to an end of said pressure tube having an axial setback Δ from said sound-generating end;

a polyethylene, polypropylene, cellophane, paper or rubber membrane having a thickness V between 0.01 and 2 mm stretched across said sound-generating end of said sound tube and said end of said pressure tube, said sound tube having an internal diameter $D_1$ at said sound-generating end and said pressure tube having an internal diameter $D_2$ at said end thereof;

a retaining ring fitted over said pressure tube and anchoring said membrane thereto; and a horn-blowing hole formed laterally in said pressure tube and opening into said clearance whereby, upon blowing into said hole sound is generated by said membrane and omitted from said sound-emitting end of said sound tube, Δ ranging between substantially 0.1 and 0.3, $D_2/D_1$ ranging between substantially 1.1 and 1.7, and $D_2/V$ ranging between substantially 1000 and 2000.

2. The horn defined in claim 1, further comprising a collar engaging said sound tube and pressure tube at the sound-emitting end.

3. The horn defined in claim 2 wherein said collar is formed with a recess receiving an extension tube.

4. The horn defined in claim 3 wherein said tube is formed with a recess receiving a further extension tube.

5. The horn defined in claim 4 wherein Δ is substantially 0.2.

6. The horn defined in claim 4 wherein $D_2/D_1$ is substantially 1.3.

7. The horn defined in claim 4 wherein $D_2/v$ is substantially 1400.

8. The horn defined in claim 4 wherein said sound hole has a diameter of substantially 0.2 to substantially 50 mm.

9. The horn defined in claim 8 wherein said diameter of said hole is substantially 10 mm.

10. The horn defined in claim 8 wherein said clearance has a width of at least 0.2 mm.

* * * * *